US011857889B2

(12) United States Patent
Wang

(10) Patent No.: US 11,857,889 B2
(45) Date of Patent: Jan. 2, 2024

(54) SPINNING MAGNETIC TOY BLOCK

(71) Applicant: Howard Wang, Hacienda Heights, CA (US)

(72) Inventor: Howard Wang, Hacienda Heights, CA (US)

( * ) Notice: Subject to any disclaimer, the term of this patent is extended or adjusted under 35 U.S.C. 154(b) by 276 days.

(21) Appl. No.: 17/463,894

(22) Filed: Sep. 1, 2021

(65) Prior Publication Data

US 2023/0011988 A1 Jan. 12, 2023

Related U.S. Application Data

(63) Continuation-in-part of application No. 29/798,708, filed on Jul. 9, 2021.

(51) Int. Cl.
*A63H 33/06* (2006.01)
*A63H 33/04* (2006.01)

(52) U.S. Cl.
CPC ..... *A63H 33/042* (2013.01); *A63H 33/046* (2013.01)

(58) Field of Classification Search
CPC ..... A63H 33/046; A63H 33/04–14
USPC ..... 40/431, 442
See application file for complete search history.

(56) References Cited

U.S. PATENT DOCUMENTS 3,488,880 A * 1/1970 Taylor ..... A63H 33/22 40/493
4,536,162 A * 8/1985 Ace, Jr. ..... A63H 33/065 446/487
5,575,701 A * 11/1996 Hantman ..... A63H 33/10 446/104
8,028,447 B2 * 10/2011 Dunham ..... B44C 5/00 40/442
8,128,452 B2 * 3/2012 Kim ..... A63H 33/046 446/92
9,433,871 B2 * 9/2016 Park ..... A63H 33/102
11,077,385 B2 * 8/2021 Kogure ..... A63H 33/10
11,458,410 B2 * 10/2022 Xu ..... A63H 33/046
11,642,604 B1 * 5/2023 Xie ..... A63H 33/046 446/92
2002/0065018 A1 * 5/2002 Huang ..... A63H 33/042 446/95
2002/0098774 A1 * 7/2002 Huang ..... A63H 33/04 434/167
2009/0197500 A1 * 8/2009 Song ..... A63H 33/046 446/92

(Continued)

FOREIGN PATENT DOCUMENTS

JP 5880754 3/2016

*Primary Examiner* — Eugene L Kim
*Assistant Examiner* — Matthew B Stanczak
(74) *Attorney, Agent, or Firm* — Clement Cheng

(57) ABSTRACT

A set of magnetic spinning toy blocks can include eight magnetic spinning toy blocks, and each of the magnetic spinning toy blocks can have a similar structure. The magnetic spinning toy block includes a frame having a frame opening. The frame has magnet retainers formed as chambers in the frame at a periphery of the frame. Magnets are mounted within the magnet retainers, and the magnets include a pair of upper magnets which include an right upper magnet and a left upper magnet. The magnets include pair of lower magnets which include a right lower magnet and a left lower magnet. The frame holds a rotating panel and the rotating panel is mounted within the frame.

10 Claims, 11 Drawing Sheets

(56) References Cited

U.S. PATENT DOCUMENTS

| | | | | |
|---|---|---|---|---|
| 2012/0302127 | A1* | 11/2012 | Doskas | A63H 33/046 446/92 |
| 2013/0267145 | A1* | 10/2013 | Rosen | A63H 33/046 446/92 |
| 2014/0227934 | A1* | 8/2014 | Rudisill | A63H 33/046 446/92 |
| 2015/0231521 | A1* | 8/2015 | Peterson | B29C 65/56 446/92 |
| 2015/0258463 | A1* | 9/2015 | Park | A63H 33/102 446/124 |
| 2016/0074766 | A1* | 3/2016 | Choi | A63H 33/046 446/92 |
| 2016/0184727 | A1* | 6/2016 | Ornstein | A63H 33/046 446/92 |
| 2016/0199749 | A1* | 7/2016 | Whittaker | A63H 33/046 434/278 |
| 2017/0065899 | A1* | 3/2017 | Moskowitz | A63H 33/046 |
| 2018/0056206 | A1* | 3/2018 | Micko | A63H 33/046 |
| 2019/0232186 | A1* | 8/2019 | Wong | A63H 33/062 |
| 2020/0147508 | A1* | 5/2020 | Romanoff | A63H 33/086 |
| 2020/0246715 | A1* | 8/2020 | Bensussan | A63H 33/10 |
| 2022/0297021 | A1* | 9/2022 | Liu | A63H 33/22 |
| 2023/0011988 | A1* | 1/2023 | Wang | A63H 33/042 |

* cited by examiner

SPINNING MAGNETIC TOY BLOCK

The present invention claims priority from United States design patent 29/798,708 filed Jul. 9, 2021, entitled Spinning Magnetic Toy Brick by inventor Howard Wang, the disclosure of which is incorporated herein by reference.

FIELD OF THE INVENTION

The present invention is in the field of magnetic toy blocks.

DISCUSSION OF RELATED ART

A variety of different magnetic toy block systems have interconnecting blocks as part of a construction block set. For example, in the international patent number JP5880754B2 Gear toy using rotating shaft member by inventor Yamana Tsutomu published on Mar. 9, 2016, the description discloses, "A rotated body such as a picture toy or a gear toy that is played by rotating a plurality of panels arranged in parallel and combining the images displayed on the panels, for example, has a shaft hole penetrating the rotated body. It is constructed so as to be rotatable by a shaft rod that pivots through the shaft hole and supports the rotating body. The following are provided as rotating toys such as picture matching toys and gear toys."

SUMMARY OF THE INVENTION

A set of magnetic spinning toy blocks can include eight magnetic spinning toy blocks, and each of the magnetic spinning toy blocks can have a similar structure. The magnetic spinning toy block includes a frame having a frame opening. The frame has magnet retainers formed as chambers in the frame at a periphery of the frame. Magnets are mounted within the magnet retainers, and the magnets include a pair of upper magnets which include an right upper magnet and a left upper magnet. The magnets include pair of lower magnets which include a right lower magnet and a left lower magnet. The magnets include a pair of right magnets which include an upper right magnet and a lower right magnet. The magnets include a pair of left magnets which include an upper left magnet and a lower left magnet. The frame holds a rotating panel and the rotating panel is mounted within the frame.

The pair of upper magnets is elongated and parallel to each other. The right upper magnet is elongated and parallel to the left upper magnet which is also elongated. The pair of lower magnets are elongated and parallel to each other. The right lower magnet is elongated and parallel to the left lower magnet which is also elongated. The right upper magnet and the left upper magnet are parallel to the right lower magnet and the left lower magnet. The pair of right magnets are elongated and parallel to each other. The upper right magnet is elongated and the lower right magnet is elongated. The upper right magnet is parallel to the lower right magnet. The pair of left magnets are elongated and parallel to each other. The upper left magnet is elongated and the lower left magnet is elongated. The upper left magnet is parallel to the lower left magnet.

The pair of right magnets and the pair of left magnets are perpendicularly oriented to the pair of the pair of upper magnets and the pair of lower magnets. The frame has an inside frame wall defining a boundary of the frame opening, a outside frame wall defining an exterior edge of the frame, and an intermediate frame wall formed between the inside frame wall and the outside frame wall. The magnet retainers are formed between the intermediate frame wall and the outside frame wall in an outside ring. The inside frame wall, the outside frame wall, and the intermediate frame wall all have some flexibility.

Optionally, joining studs join a first frame section to a second frame section. The joining studs are formed at the intermediate frame wall. Magnet retainer support walls are formed in the inside ring. The magnet retainer support walls extend from the inside frame wall to the intermediate frame wall, so that the inside ring supports the outside ring.

The magnet retainer support walls include: a right upper magnet retainer support wall that supports the right upper magnet retainer; a left upper magnet retainer support wall that supports the left upper magnet retainer; an upper left magnet retainer support wall that supports the upper left magnet retainer; a lower left magnet retainer support wall that supports the lower left magnet retainer; an upper right magnet retainer support wall that supports the upper right magnet retainer; a lower right magnet retainer support wall that supports the lower right magnet retainer; a right lower magnet retainer support wall that supports the right lower magnet retainer; and a left lower magnet retainer support wall the supports the left lower magnet retainer.

The magnet retainer support walls are radially oriented such that they extend outwardly from the inside frame wall to the intermediate frame wall. The rotating panel has a top hinge axle extending upwardly from a top edge of the rotating panel. The rotating panel has a bottom hinge axle extending downwardly from the bottom edge of the rotating panel. The top hinge axle extends into and is received by a top hinge socket. The bottom hinge axle extends into and is received by a bottom hinge socket. The top hinge axle and the bottom hinge axle are configured to rotate within the top hinge socket and the bottom hinge socket.

The magnetic spinning toy block optionally also has a left hinge socket and a right hinge socket in addition to the top hinge socket and the bottom hinge socket so that the magnetic spinning toy block has a total of four hinge sockets. The rotating panel has multiple user selectable modes including a first mode where the rotating panel is freely spinning relative to the frame, and a second mode where the rotating panel clicks to the frame. The rotating panel can be repeatedly removed and reinstalled at a 90° angle to select between the first mode and the second mode. The first mode is a freely spinning mode, and the second mode is a locked mode.

Figure 1:
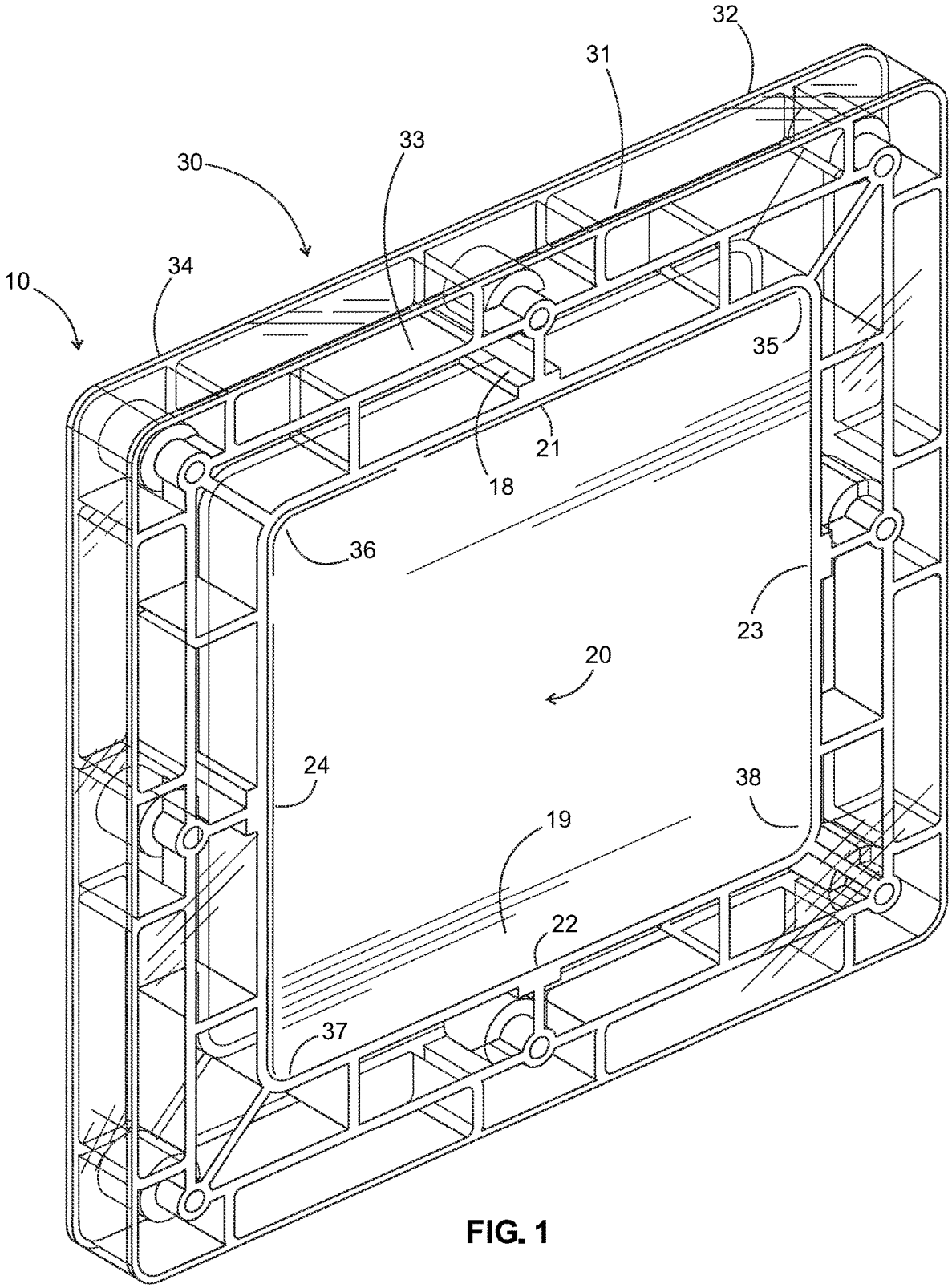
FIG. 1 is a perspective view.

The following callout list of elements can be a useful guide in referencing the element numbers of the drawings.

10 Toy block
18 top hinge
19 bottom hinge
20 rotating panel
21 panel top edge
22 panel bottom edge
23 panel right edge
24 panel left edge
30 frame
31 first frame section
32 second frame section
33 front wall
34 rear wall
35 panel top right corner
36 panel top left corner
37 panel bottom left corner
38 panel bottom right corner
39 top hinge axle
40 magnets
41 right upper magnet
42 left upper magnet
43 upper right magnet
44 lower right magnet
45 upper left magnet
46 lower left magnet
47 right lower magnet
48 left lower magnet
49 bottom hinge axle
50 magnet retainers
51 right upper magnet retainer
52 left upper magnet retainer
53 upper right magnet retainer
54 lower right magnet retainer
55 upper left magnet retainer
56 lower left magnet retainer
57 right lower magnet retainer
58 left lower magnet retainer
61 inside frame wall
62 intermediate frame wall
63 outside frame wall
64 inside ring
65 outside ring
66 stop tab
71 right upper magnet retainer support wall
72 left upper magnet retainer support wall
73 upper right magnet retainer support wall
74 lower right magnet retainer support wall
75 upper left magnet retainer support wall
76 lower left magnet retainer support wall
77 right lower magnet retainer support wall
78 left lower magnet retainer support wall
80 joining studs
81 upper right stud
82 upper middle stud
83 upper left stud
84 right middle stud
85 left middle stud
86 lower right stud
87 lower middle stud
88 lower left stud
91 upper right stud chamber
92 upper middle stud
93 upper left stud chamber
94 right middle stud chamber
95 left middle stud chamber
96 lower right stud chamber
97 lower middle stud chamber
98 lower left stud chamber
101 upper right stud chamber support wall
102 upper middle stud chamber support wall
103 upper left stud chamber support wall
104 right middle stud chamber support wall
105 left middle stud chamber support wall
106 lower right stud chamber support wall
107 lower middle stud chamber support wall
108 lower left stud chamber support wall
121 upper right stop tab
122 upper left stop tab
123 lower right stop tab
124 lower left stop tab
125 right rotating panel section
126 left rotating panel section
131 Top hinge socket
132 right hinge socket
133 left hinge socket
134 bottom hinge socket
135 right upper frame stop
136 left upper frame stop
137 right lower frame stop
138 left lower frame stop

DETAILED DESCRIPTION OF THE PREFERRED EMBODIMENT

As seen in FIG. 1, a toy block 10 can be made as a plastic injection molded block has a frame 30 that retains a rotating panel 20. The rotating panel 20 has a panel top edge 21 and a panel bottom edge 22 in a rectangular shape which can be square. The rotating panel 20 if square has a panel top right corner 35, a panel bottom right corner 38, a panel bottom left corner 37, and a panel top left corner 36. Additionally, the rotating panel 20 has a panel right edge 23 and a panel left edge 24. The rotating panel has a top hinge 35 at a panel top edge 21 and a bottom hinge 19 at a panel bottom edge 22.

The frame 30 can also be rectangular with a front frame portion and a rear frame portion. A first frame section 31 including a front wall 33 fits to a second frame section 32 including a rear wall 34. The first frame section 31 and the second frame section 32 can fit together by interference fit such as a snap connection. The front wall 33 and the rear wall 34 can be translucent to allow light to pass through the frame 30. The rotating panel 20 can also be translucent to allow light to pass through the rotating panel 20. The bottom hinge 19 can be made using a protrusion from the panel bottom edge 22. Also, the top hinge 35 can be made with a protrusion extending upwardly from the panel top edge 21 so that the protrusion extends into the frame 30.

Figure 2:
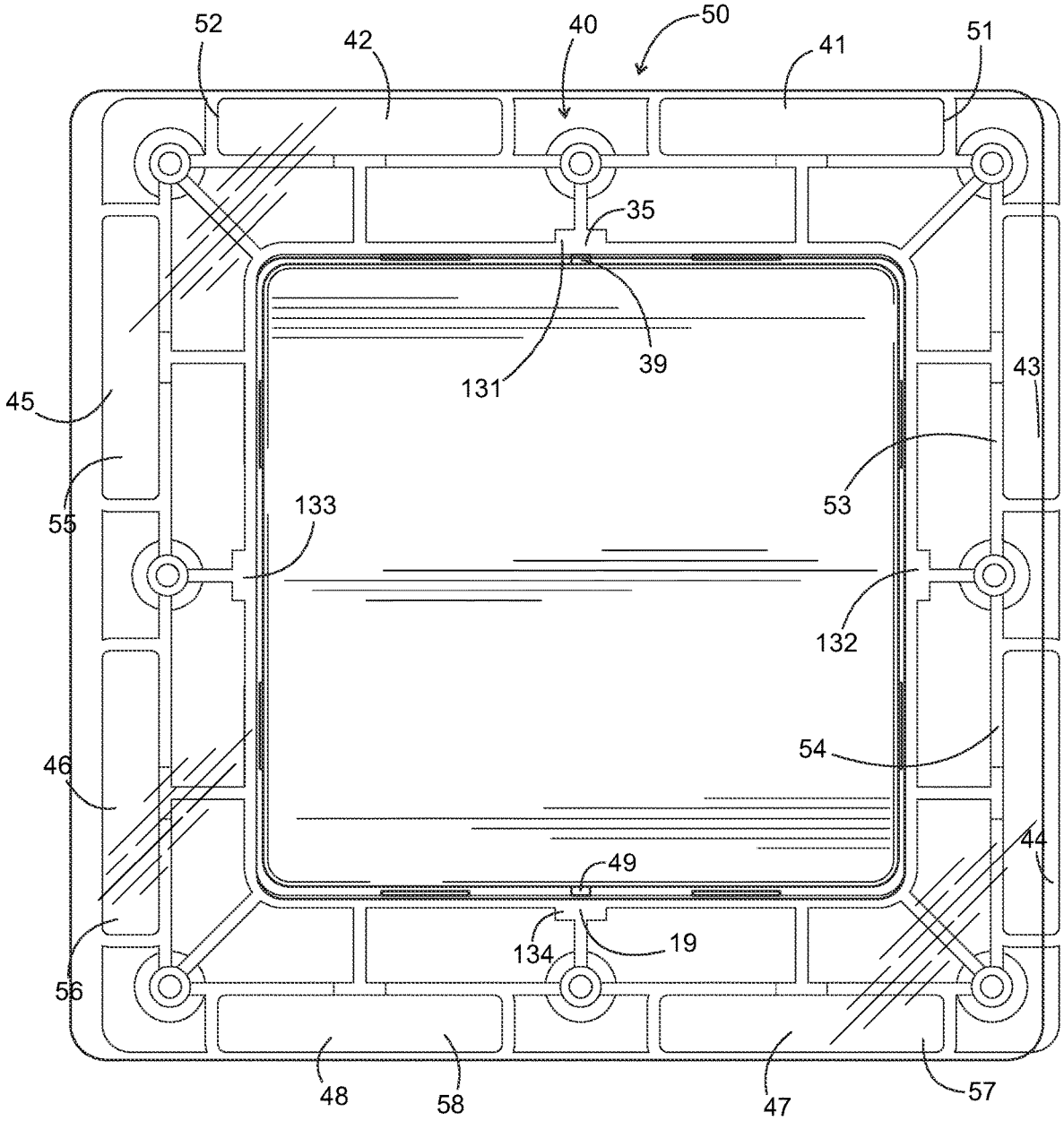
FIG. 2 is a front view.

As seen in FIG. 2, the periphery of the frame 30 includes magnet retainers 50 retaining magnets 40. The magnets 40 may include a right upper magnet 41, a left upper magnet 42, a right lower magnet 47 and the left lower magnet 48 in a horizontal orientation. The magnets 40 may also include an upper right magnet 43, a lower right magnet 44, an upper left magnet 45, and a lower left magnet 46 in a vertical orientation. The magnet retainers 50 are formed as chambers in the frame 30. The right upper magnet 41 is mounted within the right upper magnet retainer 51. The left upper magnet retainer 52 retains of the left upper magnet 42, the upper right magnet retainer 53 retains the upper right magnet 43. The lower right magnet retainer 54 retains the lower right magnet 44. The upper left magnet retainer 55 retains the upper left magnet 45. The lower left magnet retainer 56 retains the lower left magnet 46. The magnet retainers formed as rectangular chambers in a vertical or horizontal orientation are disposed along the periphery of the frame 30.

On the inside of the frame, the top hinge axle 39 of the top hinge 35 may extend upwardly from the rotating panel 20, and the bottom hinge axle 49 of the bottom hinge 19 may extend downwardly from the rotating panel 20. The top hinge axle 39 receives into a top hinge socket 131 and the bottom hinge axle 49 extends into the bottom hinge socket 134. The rotating panel 20 can be removed and reinstalled sideways so that the top hinge axle 39 extends into the left hinge socket 133 while the bottom hinge axle 49 extends into the right hinge socket 132. The rotating panel 20 can be removed because the frame 30 has flexibility. The frame has an opening that receives the rotating panel 20. The opening can be square or rectangular with one side slightly longer than the other to facilitate a bimodal implementation of the rotating panel 20.

Figure 3:
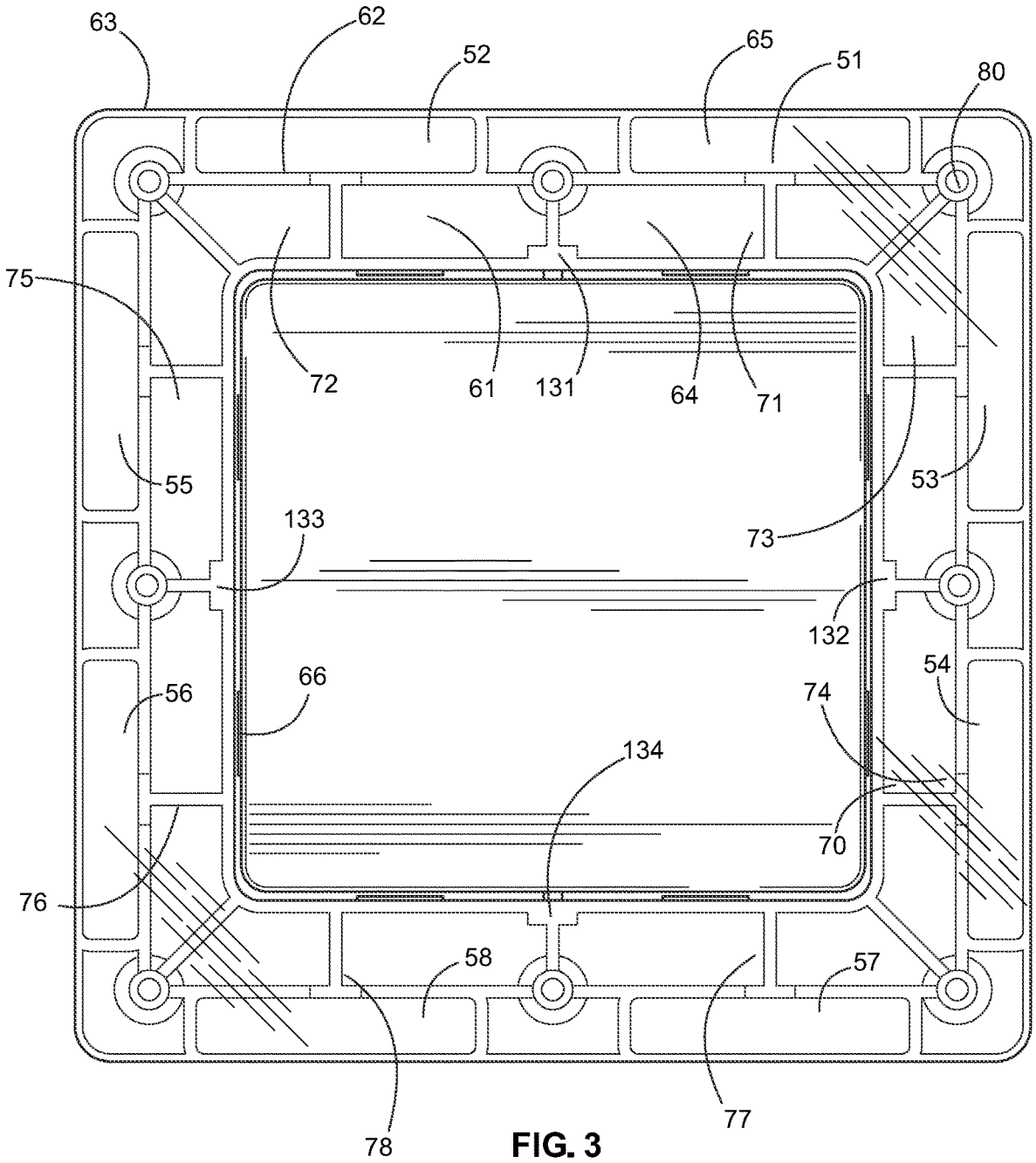
FIG. 3 is a rear view.
Figure 4:
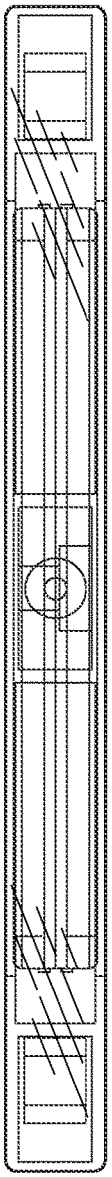
FIG. 4 is a left side view.
Figure 5:
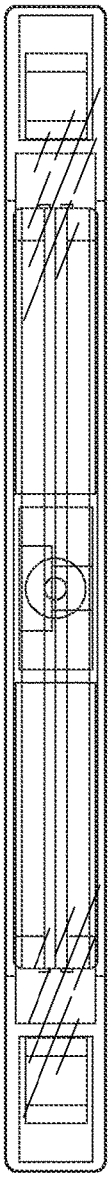
FIG. 5 is a right side view.
Figure 6:
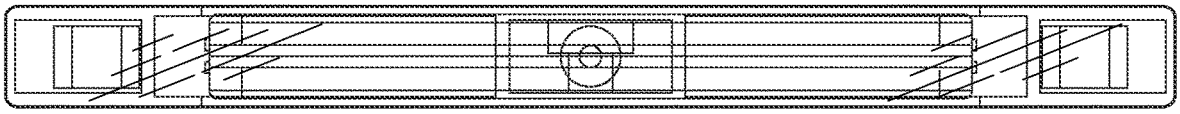
FIG. 6 is a top view.
Figure 7:
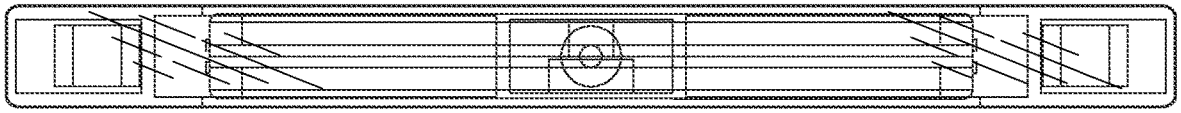
FIG. 7 is a bottom view.

As seen in FIG. 3, the frame 30 has an inside frame wall 61, a outside frame wall 63, and an intermediate frame wall 62 formed between the inside frame wall 61 and the outside frame wall 63. The periphery of the frame 30 is formed between the intermediate frame wall 62 and the outside frame wall 63. The magnet retainers 50 are formed between the intermediate frame wall 62 and the outside frame wall 63 in an outside ring 65. Joining studs 80 join the first frame section 31 to the second frame section 32. Joining studs 80 are formed along the intermediate frame wall 62. The inside frame wall 61, the outside frame wall 63 and the intermediate frame wall 62 all have some flexibility.

Magnet retainer support walls 70 are formed in the inside ring 64. The inside ring 64 supports the outside ring 65. The right upper magnet retainer support wall 71 supports the right upper magnet retainer 51 and the left upper magnet retainer support wall 72 supports the left upper magnet retainer 52. The upper left magnet retainer support wall 75 supports the upper left magnet retainer 55 and the lower left magnet retainer support wall 76 supports the lower left magnet retainer 56. The upper right magnet retainer support wall 73 supports the upper right magnet retainer 53, and the lower right magnet retainer support wall 74 supports the lower right magnet retainer 54. The right lower magnet retainer support wall 77 supports the right lower magnet retainer 57, and the left lower magnet retainer support wall 78 supports the left lower magnet retainer 58.

FIGS. 4-7 show the side views and the top and bottom views of the frame 30 which are congruent with each other. The hinge sockets that receive the hinge axles are also located on the left and right sides so that the rotating panel 20 can be removed and reinstalled sideways so that it rotates horizontally instead of vertically. The frame 30 is thus symmetrical in the left and right direction as well as the top and bottom direction such that it has two planes of symmetry.

Figure 8:
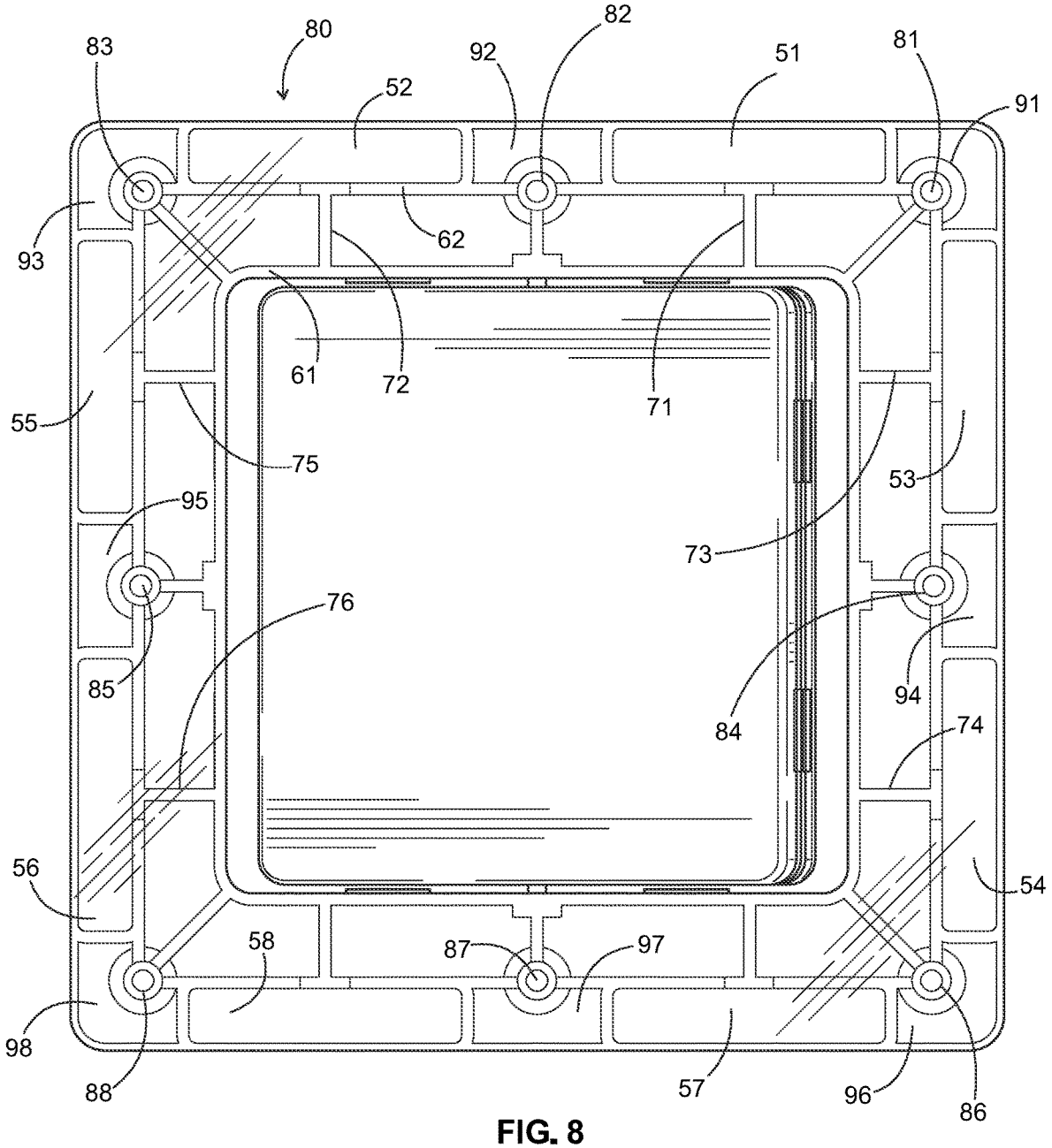
FIG. 8 is a front view of a first rotating position.

As seen in FIG. 8, the joining studs 80 include an upper right stud 81 adjacent to an upper right stud chamber 91. The upper right stud chamber 91 is formed between the right upper magnet retainer 51 and the upper right magnet retainer 53. The upper middle stud 82 is formed adjacent to the upper middle stud chamber 92. The upper middle stud chamber 92 is formed between the right upper magnet retainer 51 and the left upper magnet retainer 52. The left upper stud 83 is formed at the upper left stud chamber 93 and the upper left stud chamber 93 is formed between the left upper magnet retainer 52 and the upper left magnet retainer 55. The left middle stud 85 is formed at the left middle stud chamber 95, and the left middle stud chamber 95 is formed between the upper left magnet retainer 55 and the lower left magnet retainer 56. The lower left stud 88 is formed at the lower left stud chamber 98, and the lower left stud chamber 98 is formed between the lower left magnet retainer 56 and the left lower magnet retainer 58. The lower middle stud 87 is formed at the lower middle stud chamber 97, and a lower middle stud chamber 97 is formed between the left lower magnet retainer 58 and the right lower magnet retainer 57. The lower right stud 86 is formed at the lower right stud chamber 96, and the lower right stud chamber 96 is formed between the right lower magnet retainer 57 and the lower right magnet retainer 54. The right middle stud 84 is formed at the right middle stud chamber 94, and the right middle stud chamber 94 is formed between the upper right magnet retainer 53 and the lower right magnet retainer 54.

Figure 9:
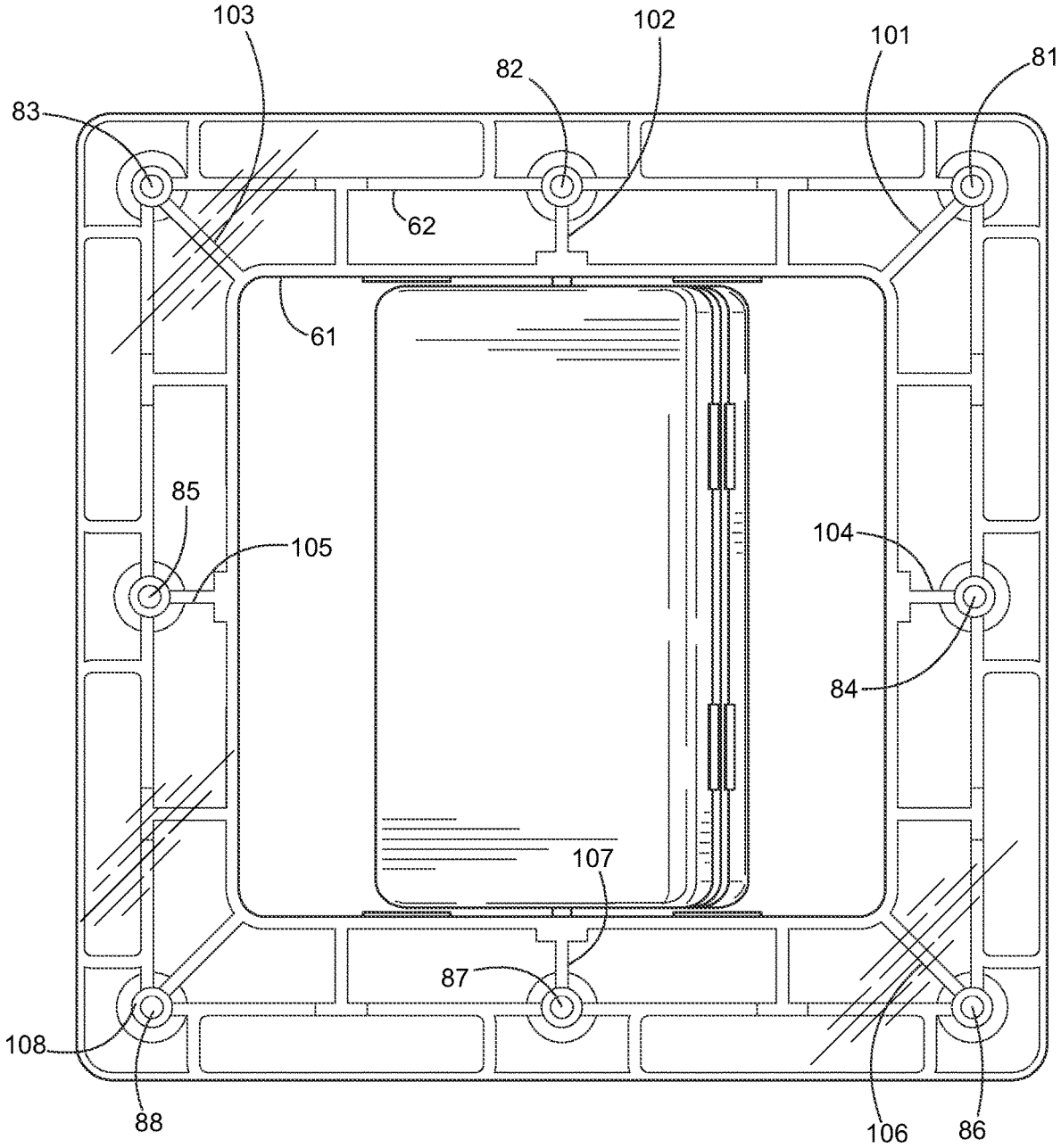
FIG. 9 is a front view of a second rotating position.

As seen in FIG. 9, the stud chamber support walls support the stud chambers, and the stud chamber support the joining studs. The upper right stud chamber support wall 101 supports the upper right stud 81. The upper middle stud chamber support wall 102 supports the upper middle stud chamber 92. The upper left stud chamber support wall 103 supports the upper left stud 83. The left middle stud chamber support wall 105 supports the left middle stud 85. The lower left stud chamber support wall 108 supports the lower left stud 88. The lower middle stud chamber support wall 107 supports the lower middle stud 87. The lower right stud chamber support wall 106 supports the lower right stud 86. The right middle stud chamber support wall 104 supports the right middle stud 84. The stud chamber support walls extend between the inside frame wall 61 and the intermediate frame wall 62. The stud chamber support walls radiate outwardly to provide structural support while allowing flexibility of the inside frame wall 61, the intermediate frame wall 62, and the outside frame wall 63.

Figure 10:
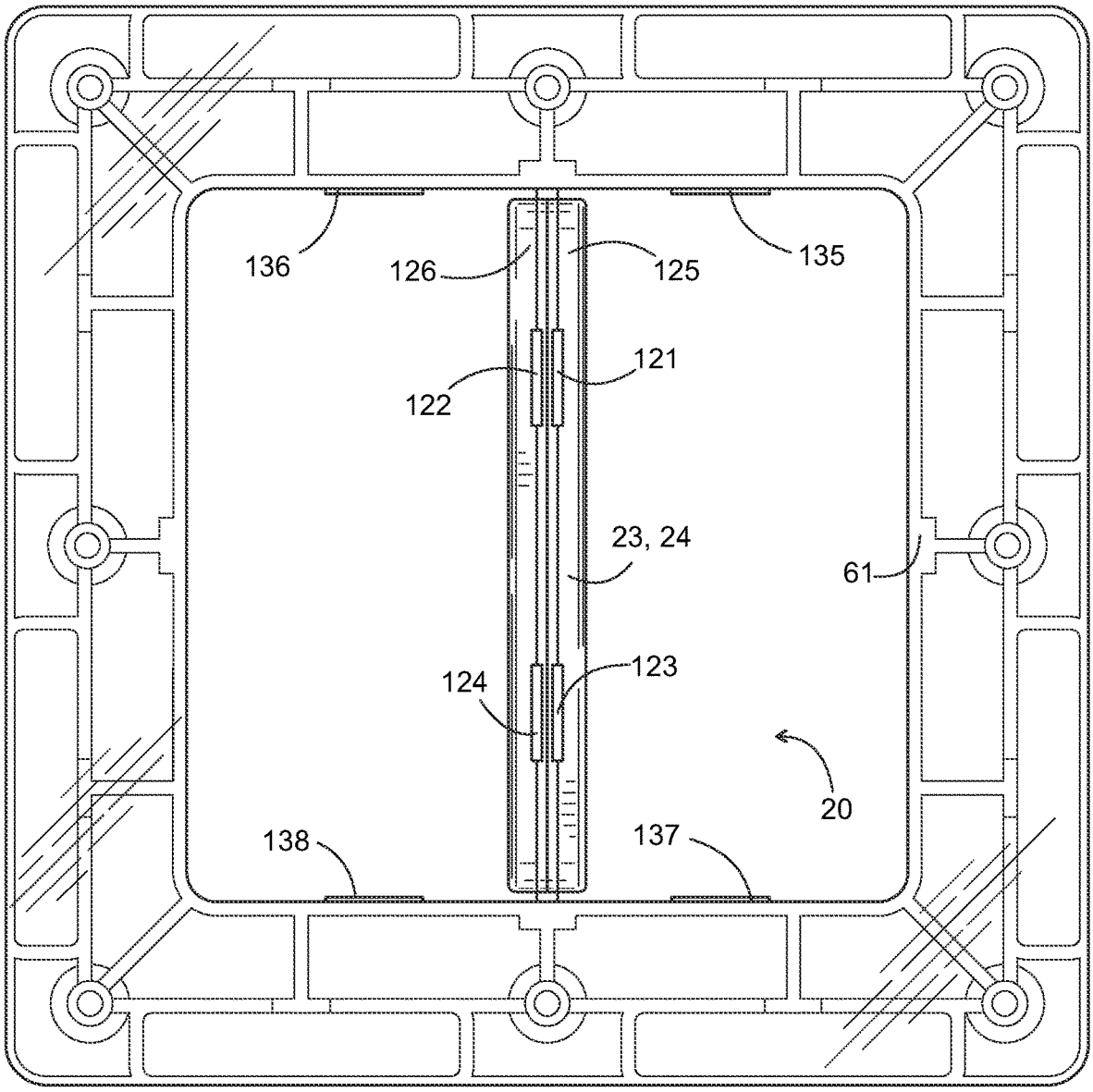
FIG. 10 is a front view of a third rotating position.

As seen in FIG. 10, the rotating panel 20 has a binary construction with a left rotating panel section 126 attaching to a right rotating panel section 125. Optionally, the rotating panel 20 has stop tabs on the left and right edges. For example, on a left or right edge, the left rotating panel section 126 can have an upper left stop tab 122, and a lower left stop tab 124. Similarly, the right rotating panel section 125 can have an upper right stop tab 121 and a lower right stop tab 123. The stop tabs can be sized to engage the edges of the frame 30. For example, the panel right edge 23 and the panel left edge 24 can have stop tabs that extends outwardly so that they touch the inside frame wall 61. The inside frame wall 61 can be sized so that the rotating panel 20 has free spinning where the stop tabs to not substantially impede the rotation of the rotating panel 20 when the rotating panel 20 is rotating on a vertical axis as shown in the figures. When the rotating panel 20 is removed and reinstalled to rotate on a horizontal axis, the rotating panel can be stopped so that it forms a rigid connection with the frame 30 and locks in place with the frame 30. Thus, the rotating panel has a pair of modes, namely a rotating mode in a vertical orientation on a vertical rotating axis, and a fixed mode in a horizontal orientation on a horizontal nonrotating axis. The rotating panel can be bimodal between a fixed position and a rotating position. The rotating panel can be reinstalled at a 90° angle for changing modes between the fixed position and the rotating position.

The inside frame wall 61 may have a right upper frame stop 135, a left upper frame stop 136, a right lower frame stop 137, and a left lower frame stop 138. The right lower frame stop 137 and left lower frame stop 138 are configured to engage the upper right stop tab 121 or the upper left stop tab 122, or the lower right stop tab 123, or the lower left stop tab 124 depending on the orientation of the rotating panel 20. The rotating panel 20 can be a spinning panel when free, and can rotate to engage the frame stops when in the engaged position. The rotating panel 20 can be clicked into the engaged position and clicked out of the engaged position.

Figure 11:
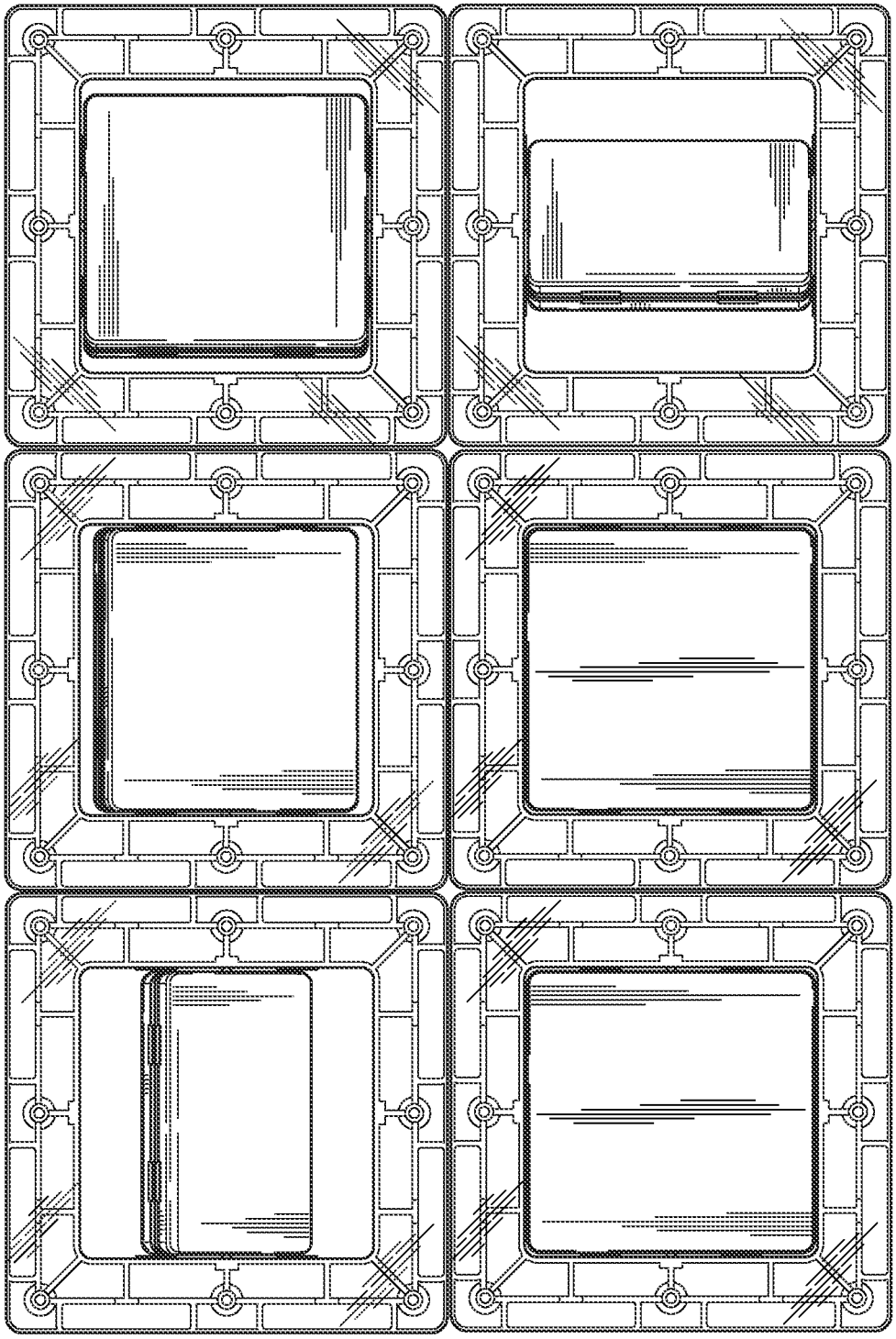
FIG. 11 is a front view of a fourth rotating position and connection to other blocks as a set.
Figure 12:
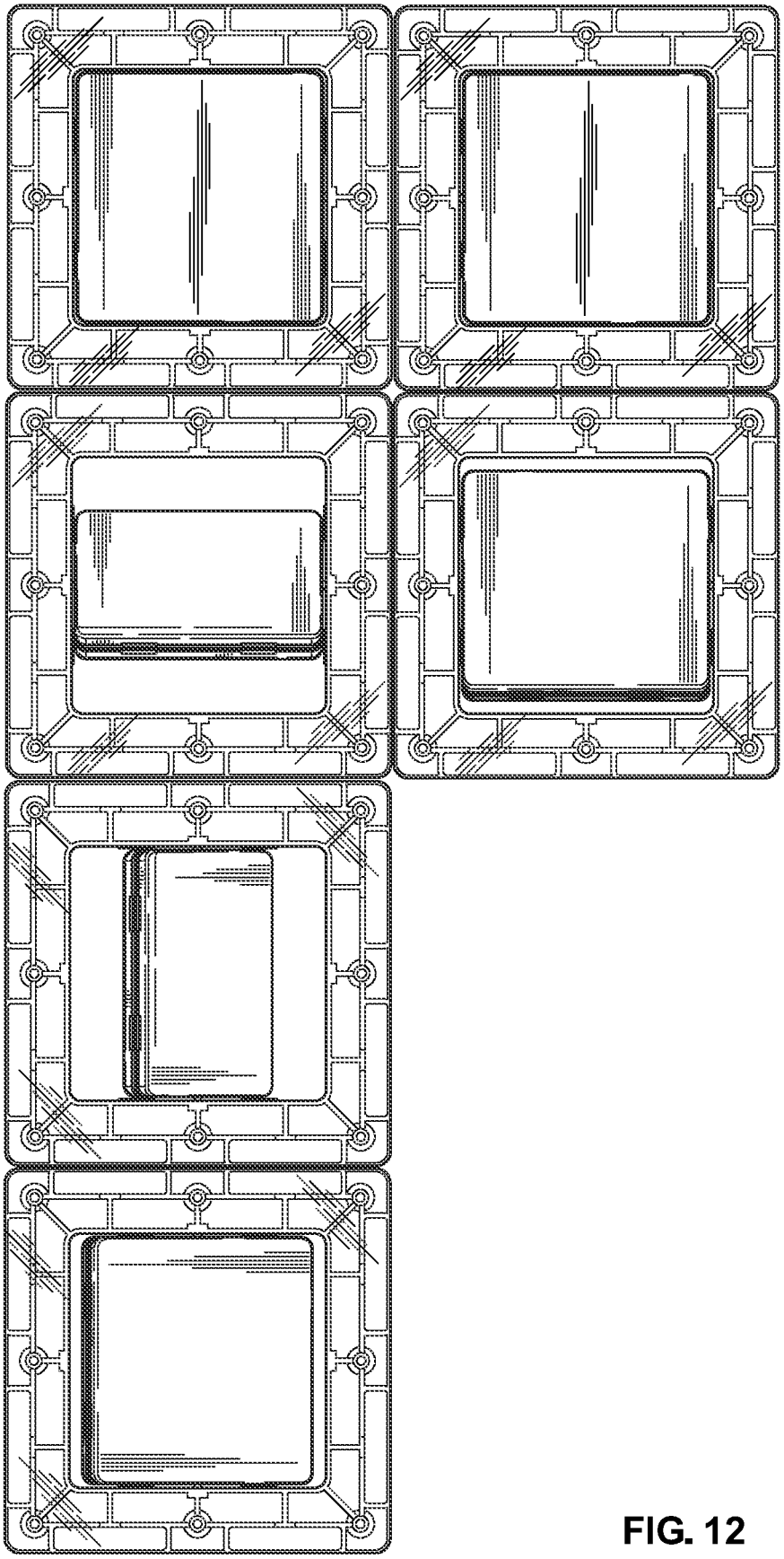
FIG. 12 is a front view of fifth rotating position and connection to other blocks as a set.
Figure 13:
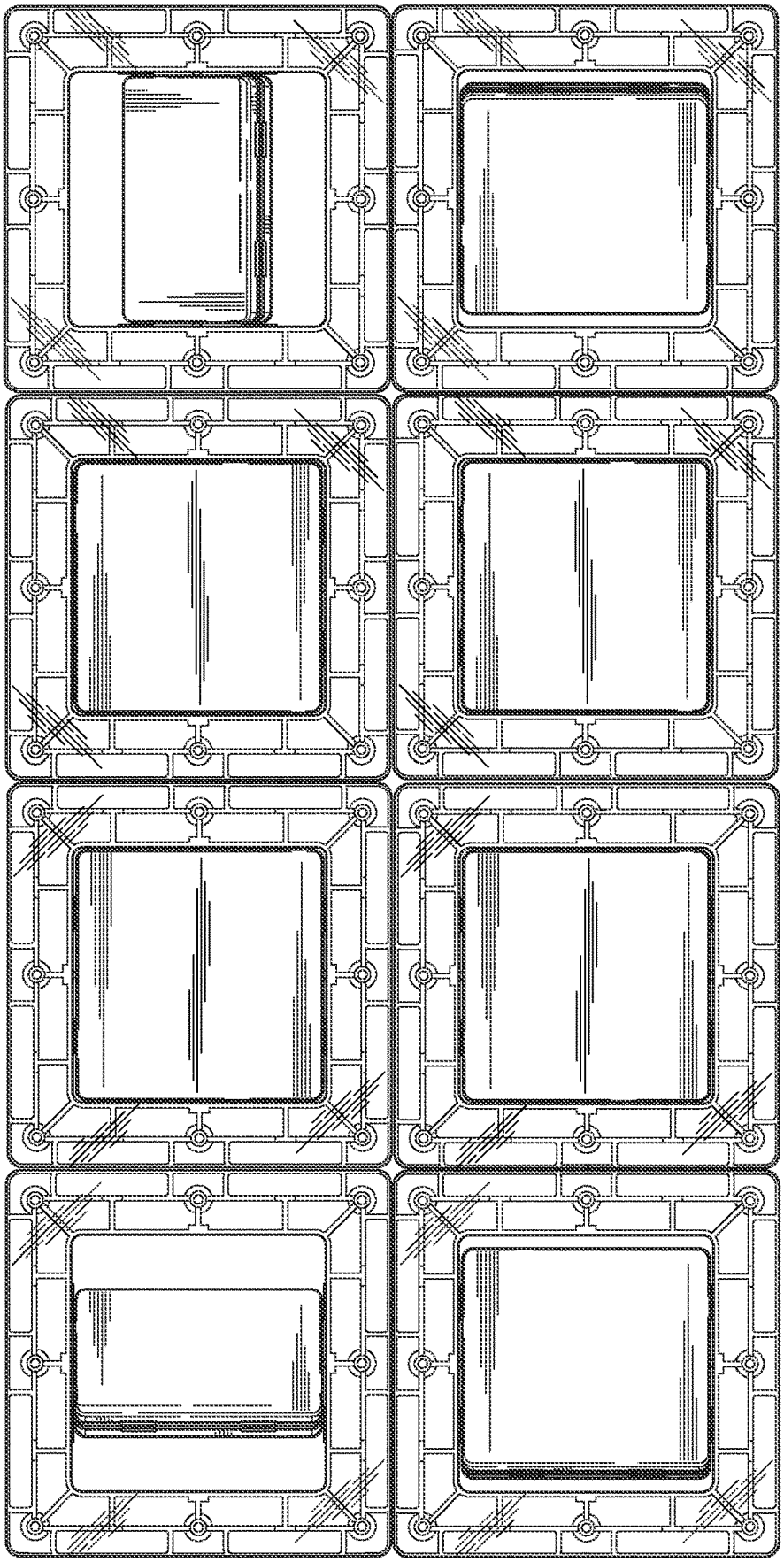
FIG. 13 is a front view of sixth rotating position and connection to other blocks as a set.
Figure 14:
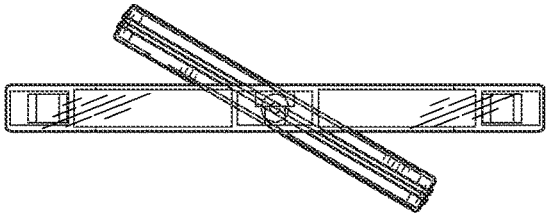
FIG. 14 is a top view of a first rotating position.
Figure 15:
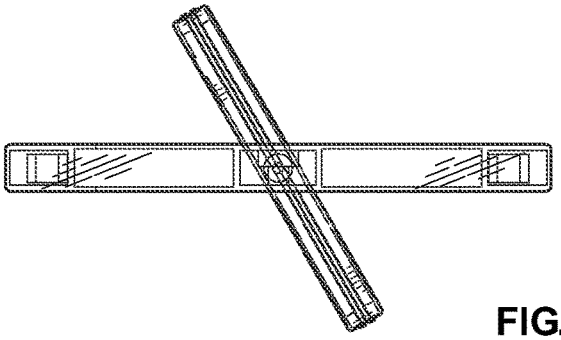
FIG. 15 is a top view of a second rotating position.
Figure 16:
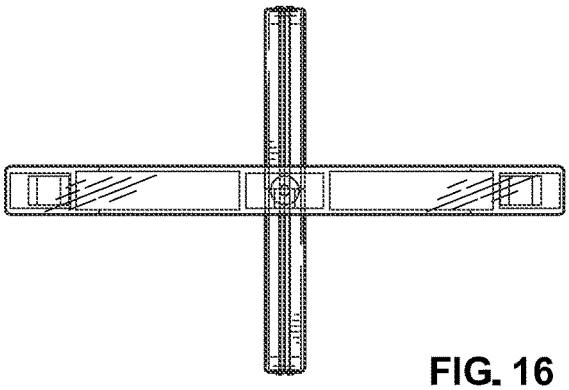
FIG. 16 is a top view of a third rotating position.
Figure 17:
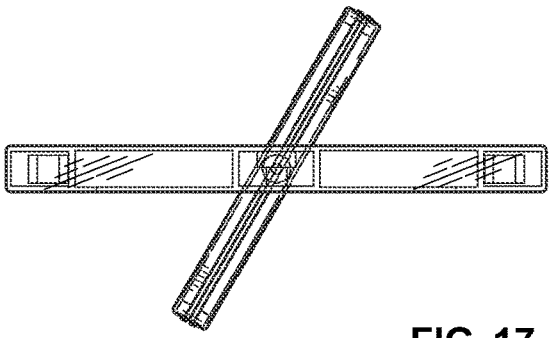
FIG. 17 is a top view of a fourth rotating position.
Figure 18:
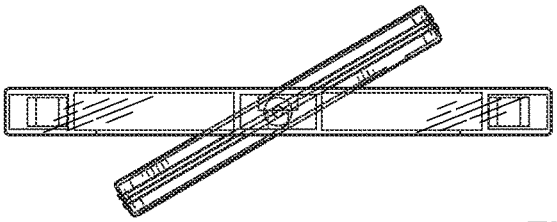
FIG. 18 is a top view of a fifth rotating position.

As seen in FIGS. 11-13, the toy blocks 10 can be stacked in a variety of different orientations and positions to form a larger structure. The magnets in different blocks attract to each other and automatically align the blocks to each other. To provide different engagement options, user has the option of rotating the frame by 90°, or removing the panel and rotating the panel to reinstall to the frame. Thus, the fixed mode and the rotating mode can be formed in a variety of different configurations.

As seen in FIGS. 14-18, the toy block has a full swing of rotation in a freely rotating mode. The toy block can still rotate in the fixed position if the user manually biases the flexible frame and snaps the block out of the fixed position, but the block does not otherwise freely spin in the fixed position.

The invention claimed is:

1. A magnetic spinning toy block comprising:

a. a frame having a frame opening, wherein the frame has magnet retainers formed as chambers in the frame at a periphery of the frame;

b. magnets mounted within the magnet retainers, wherein the magnets include a pair of upper magnets which include an right upper magnet and a left upper magnet, wherein the magnets include pair of lower magnets which include a right lower magnet and a left lower magnet, wherein the magnets include a pair of right magnets which include an upper right magnet and a lower right magnet, wherein the magnets include a pair of left magnets which include an upper left magnet and a lower left magnet; and c. a rotating panel mounted within the frame;

wherein the rotating panel has a top hinge axle extending upwardly from a top edge of the rotating panel, wherein the rotating panel has a bottom hinge axle extending downwardly from the bottom edge of the rotating panel, wherein the top hinge axle extends into and is received by a top hinge socket, wherein the bottom hinge axle extends into and is received by a bottom hinge socket, wherein the top hinge axle and the bottom hinge axle are configured to rotate within the top hinge socket and the bottom hinge socket, further including a left hinge socket and a right hinge socket, wherein the rotating panel has multiple user selectable modes including a first mode wherein the rotating panel is freely spinning relative to the frame, and a second mode where the rotating panel clicks to the frame, wherein the rotating panel can be removed and reinstalled at a 90° angle to select between the first mode and the second mode, wherein the first mode is a freely spinning mode, and wherein the second mode is a locked mode.

2. The magnetic spinning toy block of claim 1, wherein the pair of upper magnets is elongated and parallel to each other, wherein the right upper magnet is elongated and parallel to the left upper magnet which is also elongated, wherein the pair of lower magnets are elongated and parallel to each other, wherein the right lower magnet is elongated and parallel to the left lower magnet which is also elongated, wherein the right upper magnet and the left upper magnet are parallel to the right lower magnet and the left lower magnet.

3. The magnetic spinning toy block of claim 2, wherein the pair of right magnets are elongated and parallel to each other, wherein the upper right magnet is elongated and the lower right magnet is elongated, wherein the upper right magnet is parallel to the lower right magnet, and wherein the pair of left magnets are elongated and parallel to each other, wherein the upper left magnet is elongated and the lower left magnet is elongated, wherein the upper left magnet is parallel to the lower left magnet.

4. The magnetic spinning toy block of claim 3, wherein the pair of right magnets and the pair of left magnets are perpendicularly oriented to the pair of the pair of upper magnets and the pair of lower magnets.

5. The magnetic spinning toy block of claim 1, wherein the frame has an inside frame wall defining a boundary of the frame opening, a outside frame wall defining an exterior edge of the frame, and an intermediate frame wall formed between the inside frame wall and the outside frame wall.

6. The magnetic spinning toy block of claim 5, wherein the magnet retainers are formed between the intermediate frame wall and the outside frame wall in an outside ring, wherein the inside frame wall, the outside frame wall, and the intermediate frame wall are flexible.

7. The magnetic spinning toy block of claim 6, further including joining studs that join a first frame section to a second frame section, wherein the joining studs are formed at the intermediate frame wall.

8. The magnetic spinning toy block of claim 7, further including magnet retainer support walls formed in the inside ring, wherein the magnet retainer support walls extend from the inside frame wall to the intermediate frame wall, wherein the inside ring supports the outside ring.

9. The magnetic spinning toy block of claim 8, wherein the magnet retainer support walls include:

a right upper magnet retainer support wall that supports the right upper magnet retainer;

a left upper magnet retainer support wall that supports the left upper magnet retainer;

an upper left magnet retainer support wall that supports the upper left magnet retainer;

a lower left magnet retainer support wall that supports the lower left magnet retainer;

an upper right magnet retainer support wall that supports the upper right magnet retainer;

a lower right magnet retainer support wall that supports the lower right magnet retainer;

a right lower magnet retainer support wall that supports the right lower magnet retainer; and a left lower magnet retainer support wall the supports the left lower magnet retainer.

10. A set of magnetic spinning toy blocks comprising:

at least eight magnetic spinning toy blocks, wherein the at least eight magnetic spinning toy blocks each comprise:

a frame having a frame opening, wherein the frame has magnet retainers formed as chambers in the frame at a periphery of the frame;

magnets mounted within the magnet retainers, wherein the magnets include a pair of upper magnets which include an right upper magnet and a left upper magnet, wherein the magnets include pair of lower magnets which include a right lower magnet and a left lower magnet, wherein the magnets include a pair of right magnets which include an upper right magnet and a lower right magnet, wherein the magnets include a pair of left magnets which include an upper left magnet and a lower left magnet; and a rotating panel mounted within the frame, wherein the magnet retainer support walls include:

a right upper magnet retainer support wall that supports the right upper magnet retainer;

a left upper magnet retainer support wall that supports the left upper magnet retainer;

an upper left magnet retainer support wall that supports the upper left magnet retainer;

a lower left magnet retainer support wall that supports the lower left magnet retainer;

an upper right magnet retainer support wall that supports the upper right magnet retainer;

a lower right magnet retainer support wall that supports the lower right magnet retainer;

a right lower magnet retainer support wall that supports the right lower magnet retainer; and a left lower magnet retainer support wall the supports the left lower magnet retainer wherein the magnet retainer support walls are radially oriented such that they extend outwardly from the inside frame wall to the intermediate frame wall wherein the rotating panel has a top hinge axle extending upwardly from a top edge of the rotating panel, wherein the rotating panel has a bottom hinge axle extending downwardly from the bottom edge of the rotating panel, wherein the top hinge axle extends into and is received by a top hinge socket, wherein the bottom hinge axle extends into and is received by a bottom hinge socket, wherein the top hinge axle and the bottom hinge axle are configured to rotate within the top hinge socket and the bottom hinge socket further including a left hinge socket and a right hinge socket, wherein the rotating panel has multiple user selectable modes including a first mode wherein the rotating panel is freely spinning relative to the frame, and a second mode where the rotating panel clicks to the frame, wherein the rotating panel can be removed and reinstalled at a 90° angle to select between the first mode and the second mode, wherein the first mode is a freely spinning mode, and wherein the second mode is a locked mode.

* * * * *